US010167164B2

(12) United States Patent
Shen

(10) Patent No.: US 10,167,164 B2
(45) Date of Patent: Jan. 1, 2019

(54) HANDHELD TAPE DISPENSER

(71) Applicant: Hseuh-Chin Shen, New Taipei (TW)

(72) Inventor: Hseuh-Chin Shen, New Taipei (TW)

(73) Assignee: Huah Jinn Tape Searching Co., Ltd., New Taipei (TW)

( * ) Notice: Subject to any disclaimer, the term of this patent is extended or adjusted under 35 U.S.C. 154(b) by 0 days.

(21) Appl. No.: 15/871,996

(22) Filed: Jan. 16, 2018

(65) Prior Publication Data

US 2018/0237253 A1 Aug. 23, 2018

(51) Int. Cl.
*B65H 35/00* (2006.01)

(52) U.S. Cl.
CPC ..... *B65H 35/0086* (2013.01); *B65H 35/0033* (2013.01); *B65H 35/0073* (2013.01); *B65H 2551/15* (2013.01)

(58) Field of Classification Search
CPC ..... B64H 35/0086; B64H 35/0033; B64H 35/0073; B64H 35/008; B64H 2551/15; B65D 85/672; Y10T 156/1052; Y10T 83/654; Y10T 83/6644; Y10T 83/889; Y10T 83/896; Y10T 225/20; Y10T 225/238; Y10T 225/243; Y10T 225/256; Y10T 225/27; Y10T 225/271; Y10T 225/287; Y10T 225/295; Y10T 225/298
USPC ..... 242/159, 387, 396, 396.5, 396.7, 242/520–522, 526, 526.1, 527
See application file for complete search history.

(56) References Cited

U.S. PATENT DOCUMENTS

2012/0018087 A1* 1/2012 Hu ..... B65H 35/0033 156/270
2016/0207730 A1* 7/2016 Mueller ..... B65H 35/0086

* cited by examiner

*Primary Examiner* — Phong Nguyen

(57) ABSTRACT

A handheld tape dispenser includes a first shell, a second shell releasably secured to the first shell, a spring-actuated tape applying mechanism, a knife, a roll of tape, a roller member, and a tape press roller. The adhesive tape frictionally passes the roller member and a gap between the front platform and the tape press roller to extend out of a front opening. A rearward movement of the button moves blades downward to sever the adhesive tape.

1 Claim, 19 Drawing Sheets

HANDHELD TAPE DISPENSER

BACKGROUND OF THE INVENTION

1. Field of the Invention

The invention relates to handheld tape dispensers and more particularly to such a handheld tape dispenser capable of severing tape by rearward pushing a button after pulling out a desired length of the tape.

2. Description of Related Art

Conventional handheld tape dispensers are adapted to apply tape. However, these prior dispensing devices have required operator manipulation to effectively apply the free end of the tape without having to seek out the end of the tape after the preceding application. Also, it has been necessary to manipulate some mechanism during or after application of the tape such that the tape will be severed or that the free end would be retained in position for the subsequent application. Further, some operator manipulation is necessary other than the normal positioning, pressing and linear movement.

Thus, the need for improvement still exists.

Notwithstanding the prior art, the invention is neither taught nor rendered obvious thereby.

SUMMARY OF THE INVENTION

It is therefore one object of the invention to provide a handheld tape dispenser comprising a first shell including a front opening, a tongue member, a top opening, a first hollow cylindrical member, a second hollow cylindrical member, a first rib, two second ribs with the first rib disposed therebetween, a receptacle, and a groove; a second shell releasably secured to the first shell and including a front opening, a tongue member, a top opening, a receptacle, a first hollow cylindrical member joined the first hollow cylindrical member of the first shell, a longitudinal ridge, and a groove; a spring-actuated tape applying mechanism including a frame, an oval opening with the second hollow cylindrical member projecting through, a cavity adjacent to the oval opening, and a pin; a button disposed on both the top opening of the first shell and the top opening of the second shell; a pressing member under the button; a projection under the pressing member; a front platform on both the receptacle of the first shell and the receptacle of the second shell, the front platform having a plurality of ridges on a top surface; a tape core supported by the second ribs and having two aligned groove members on a bottom, the groove member being slidably placed on the first rib; and two wings on two sides of the button respectively, the wings slidably disposed in the groove of the first shell and the groove of the second shell respectively; a knife supported by the projection and including two front blades, a rear hollow cylinder pivotably put on the second hollow cylindrical member, a peg projecting downward from a bottom of the rear hollow cylinder into the cavity, a protuberance under the button, a first protrusion on an underside of the knife, and a second protrusion on the underside of the knife and being forward of the first protrusion; a roll of tape wound convolutedly on the tape core and having an adhesive tape extending therefrom; a roller member put on the pin; and a tape press roller put on both the first hollow cylindrical member of the second shell and the first hollow cylindrical member of the first shell; wherein the adhesive tape frictionally passes an outer surface of the roller member and a gap between the front platform and the tape press roller to extend out of both the front opening of the first shell and the front opening of the second shell; wherein the longitudinal ridge presses the roll of tape; wherein the peg is slidably disposed in the cavity; wherein a rearward movement of the button moves both the front platform and the pressing member rearward to uncover both the receptacle of the first shell and the receptacle of the second shell, urge the pressing member against the protuberance, pivot the knife relative to the rear hollow cylinder, cause the first protrusion to press the adhesive tape against the ridges of the front platform, engage the second protrusion with the adhesive tape, move the blades downward into the receptacles to sever the adhesive tape, and adhesively secure a front end of the adhesive tape within both the first and second shells to the ridges of the front platform.

The above and other objects, features and advantages of the invention will become apparent from the following detailed description taken with the accompanying drawings.

DETAILED DESCRIPTION OF THE INVENTION

Figure 1:
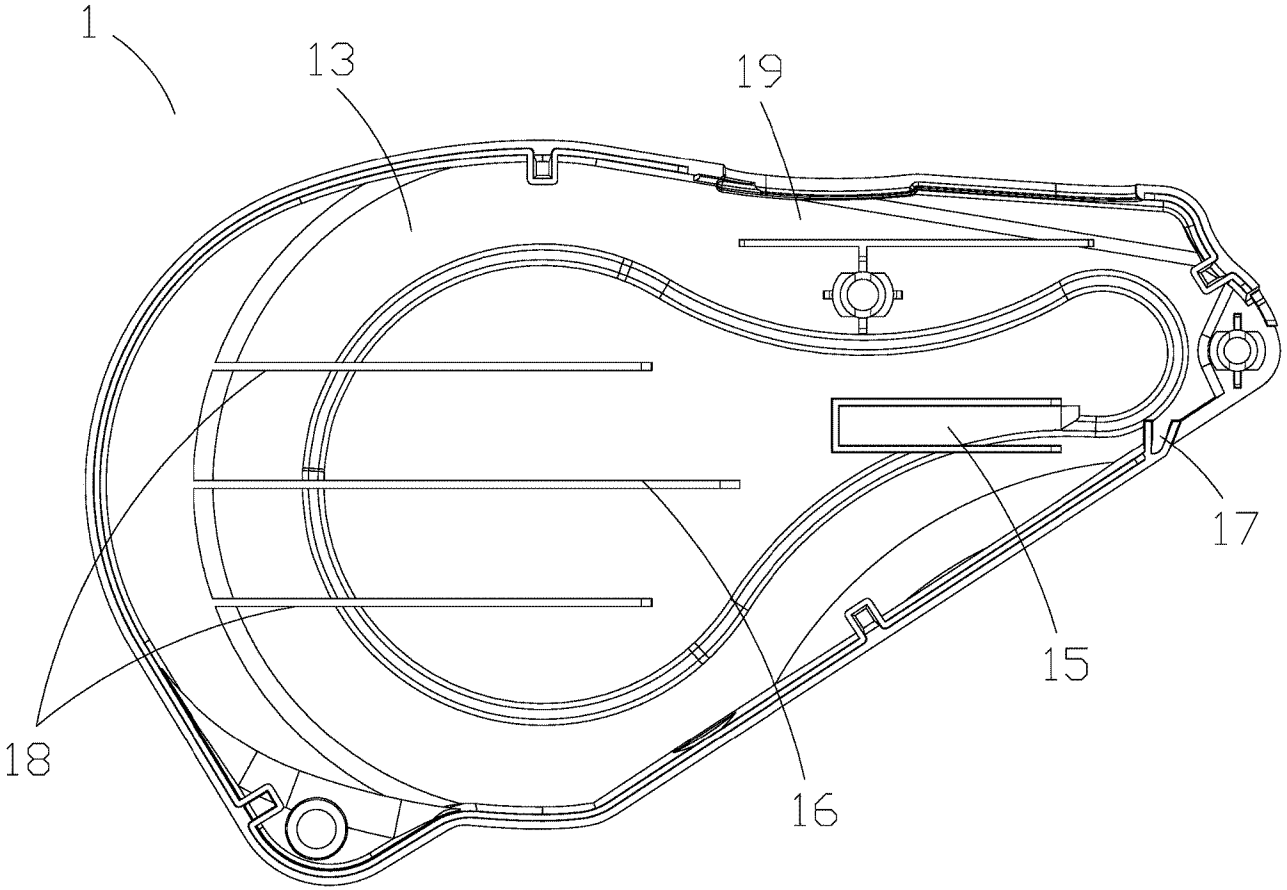
FIG. 1 is a side elevation of a first shell of a handheld tape dispenser according to the invention.
Figure 2:
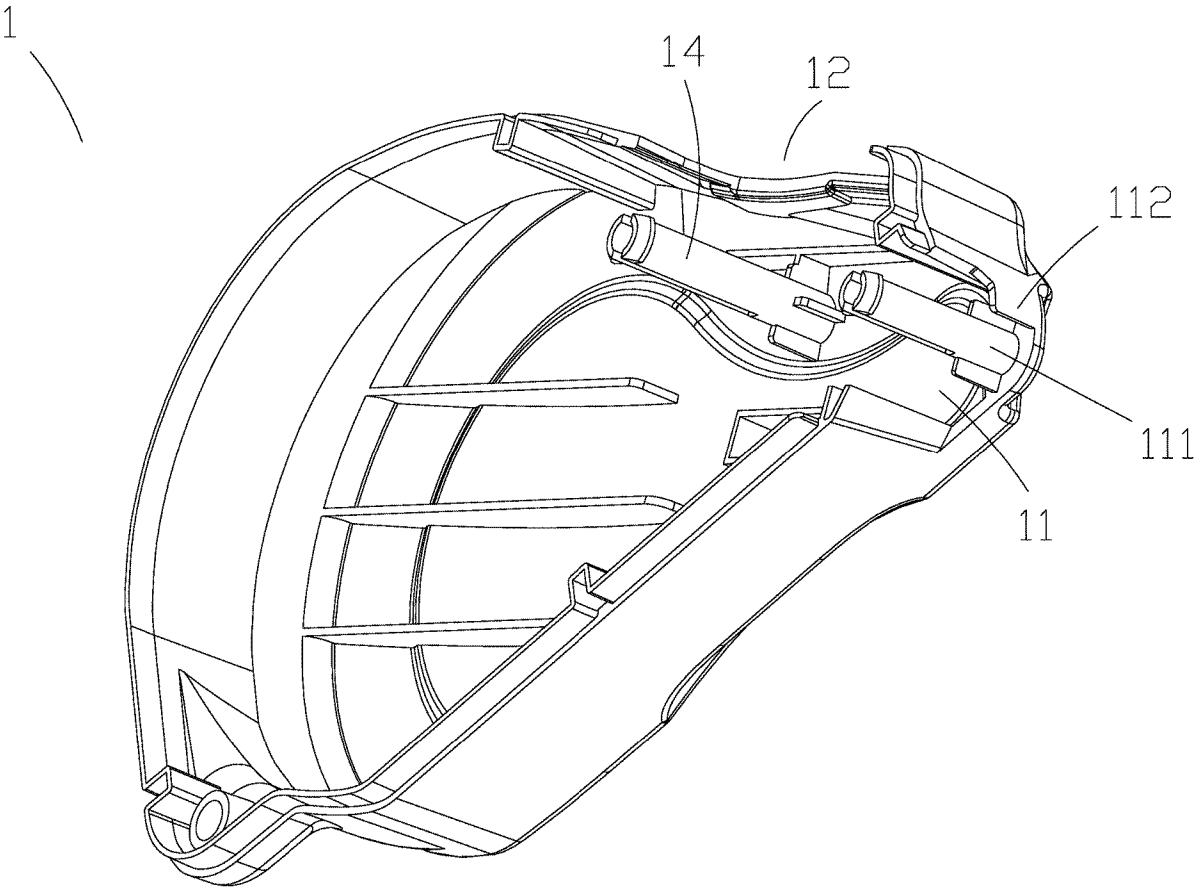
FIG. 2 is a perspective view of the first shell.
Figure 3:
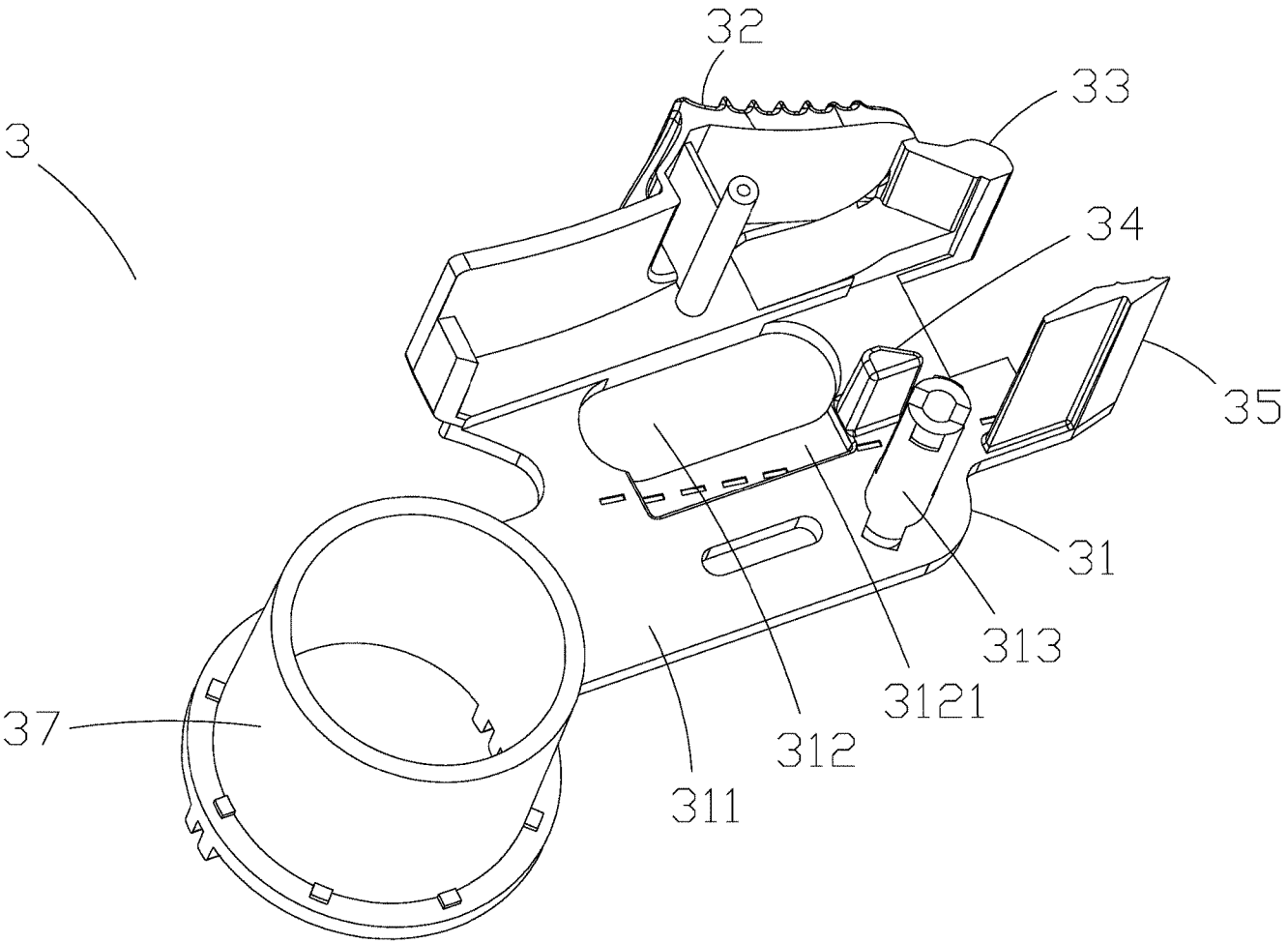
FIG. 3 is a perspective view of a tape applying mechanism of the handheld tape dispenser.
Figure 4:
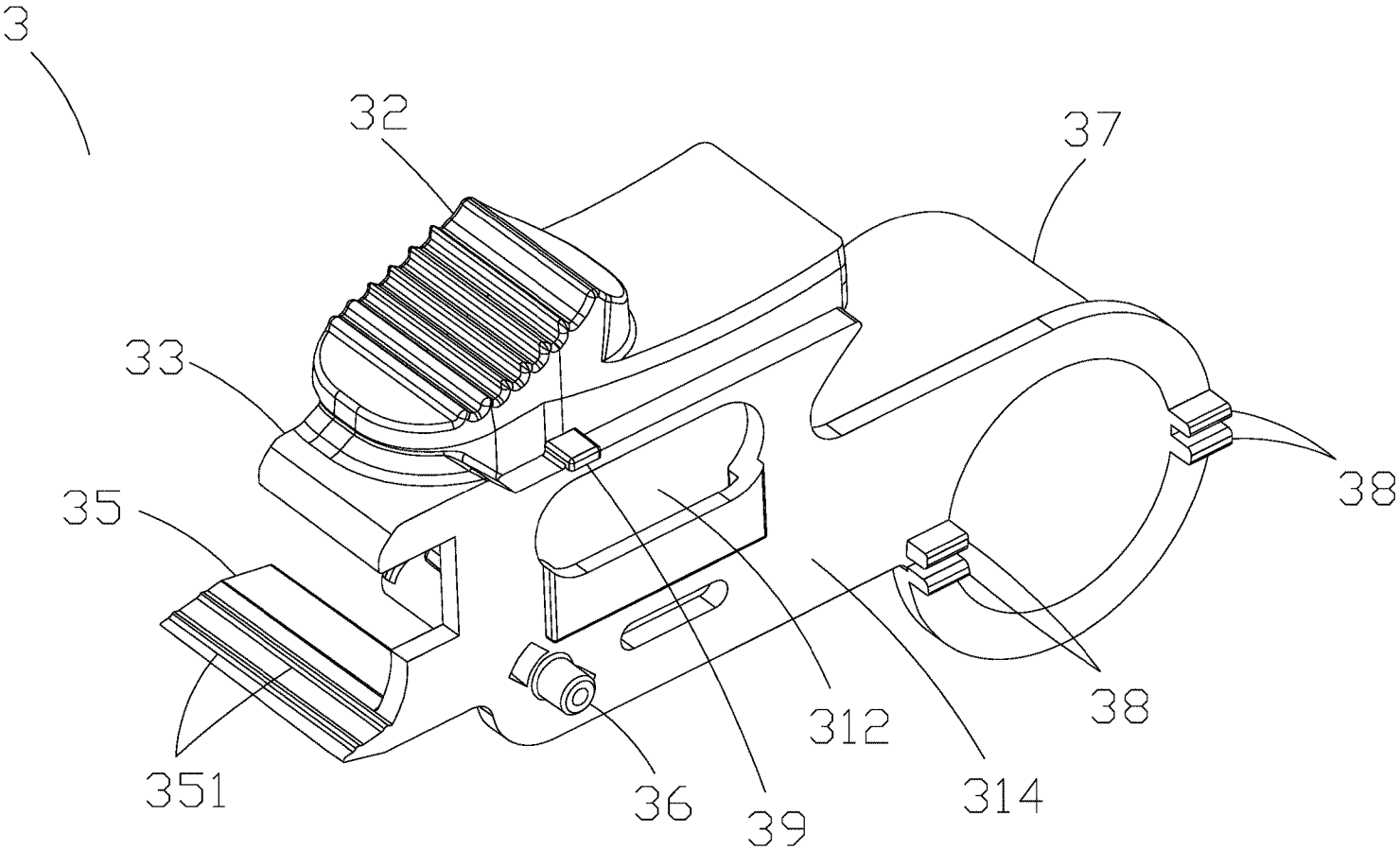
FIG. 4 is another perspective view of the tape applying mechanism of FIG. 3.
Figure 5:
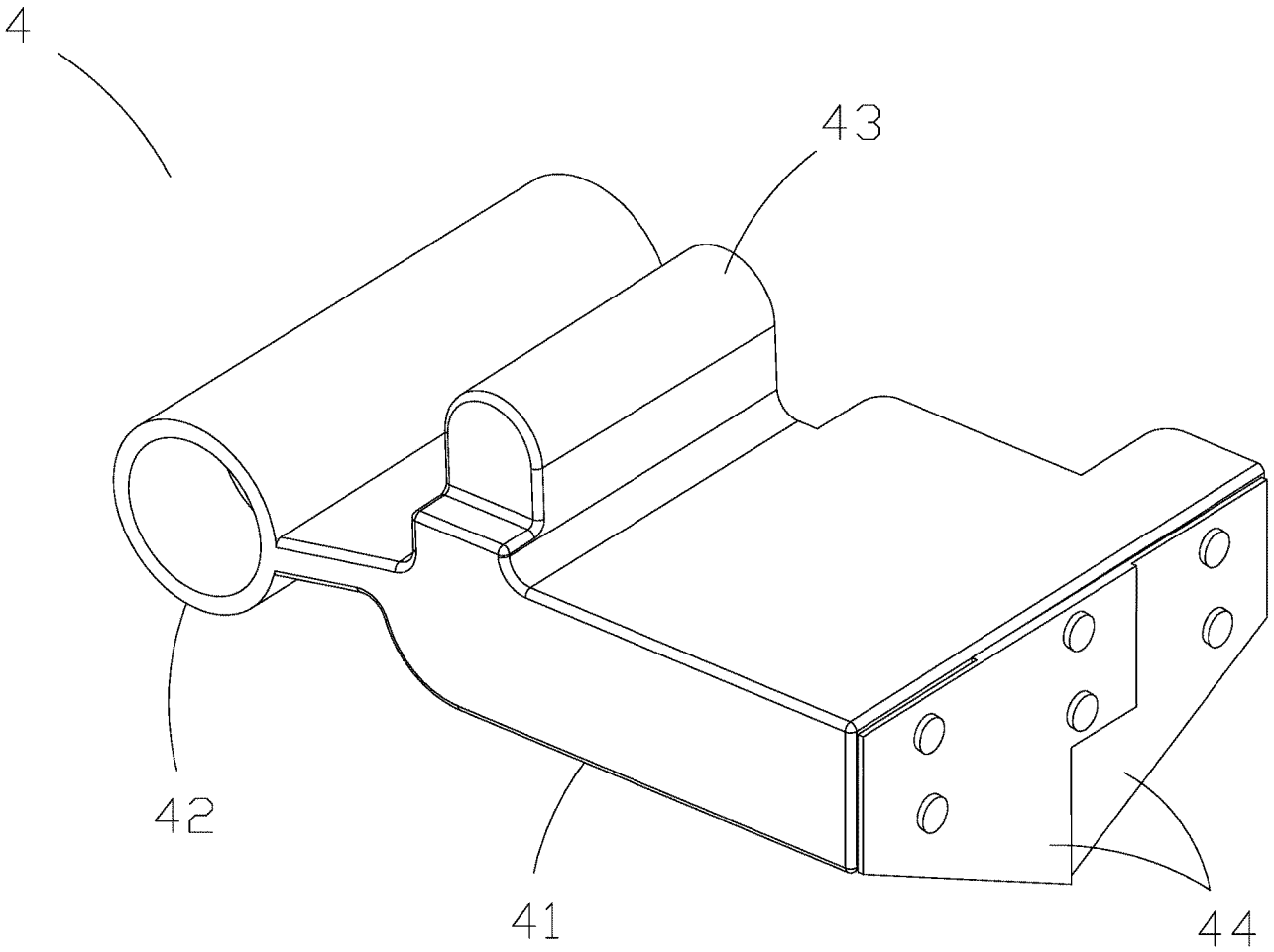
FIG. 5 is a perspective view of a knife of the handheld tape dispenser.
Figure 6:
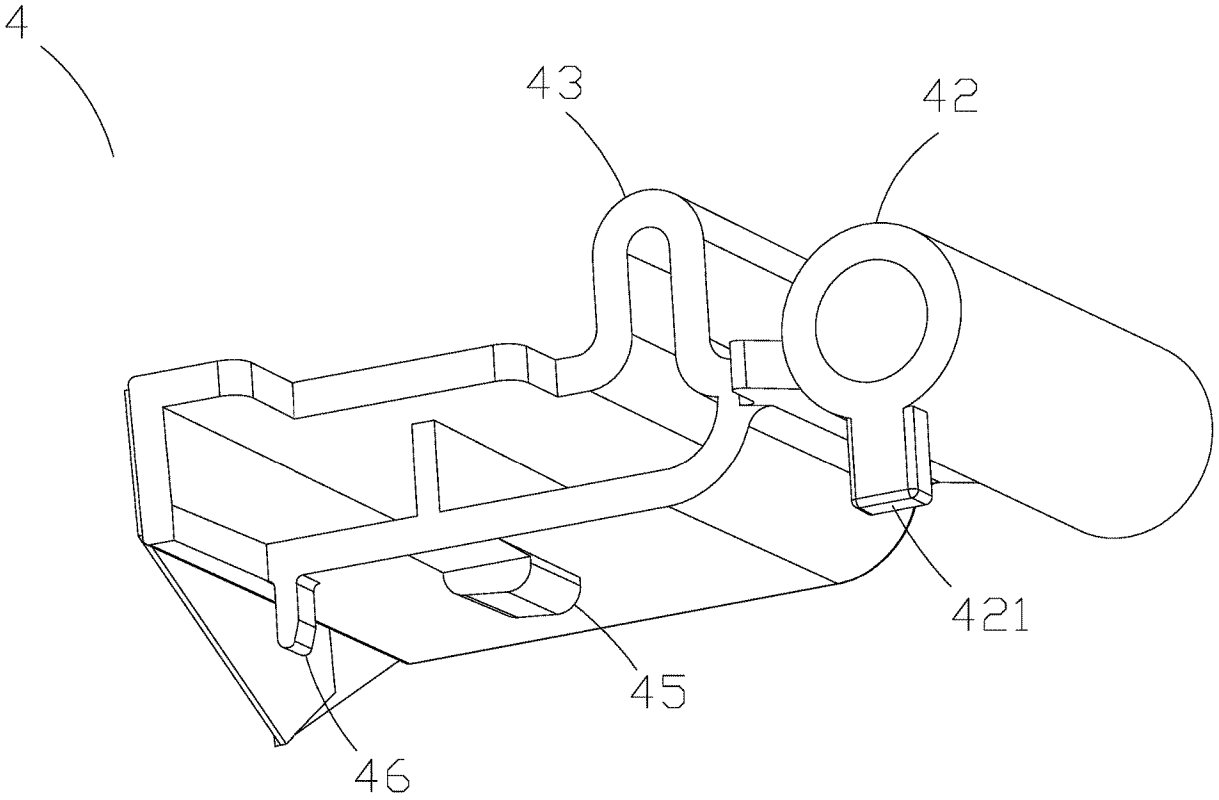
FIG. 6 is another perspective view of the knife of FIG. 5.
Figure 7:
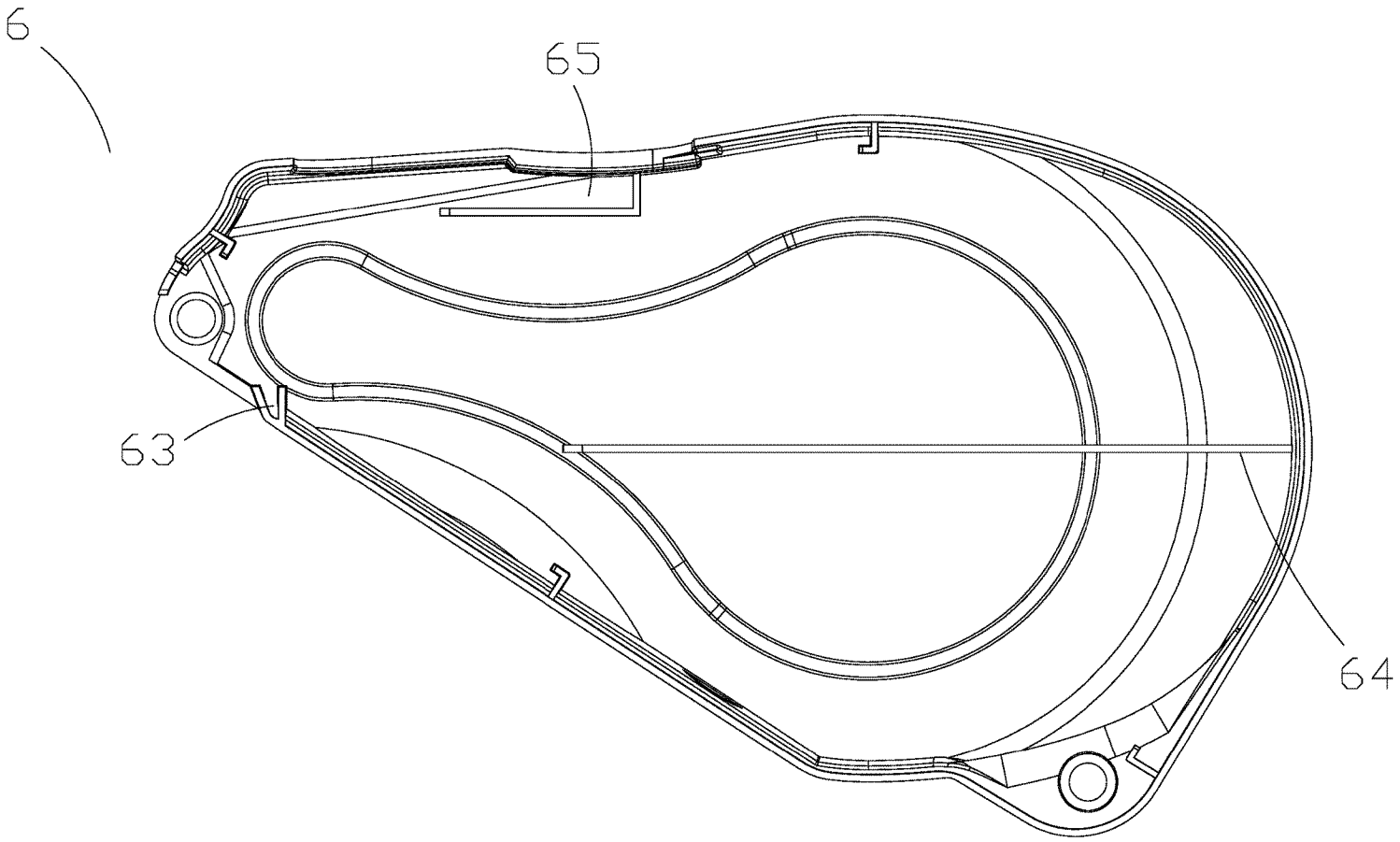
FIG. 7 is a side elevation of a second shell of the handheld tape dispenser.
Figure 8:
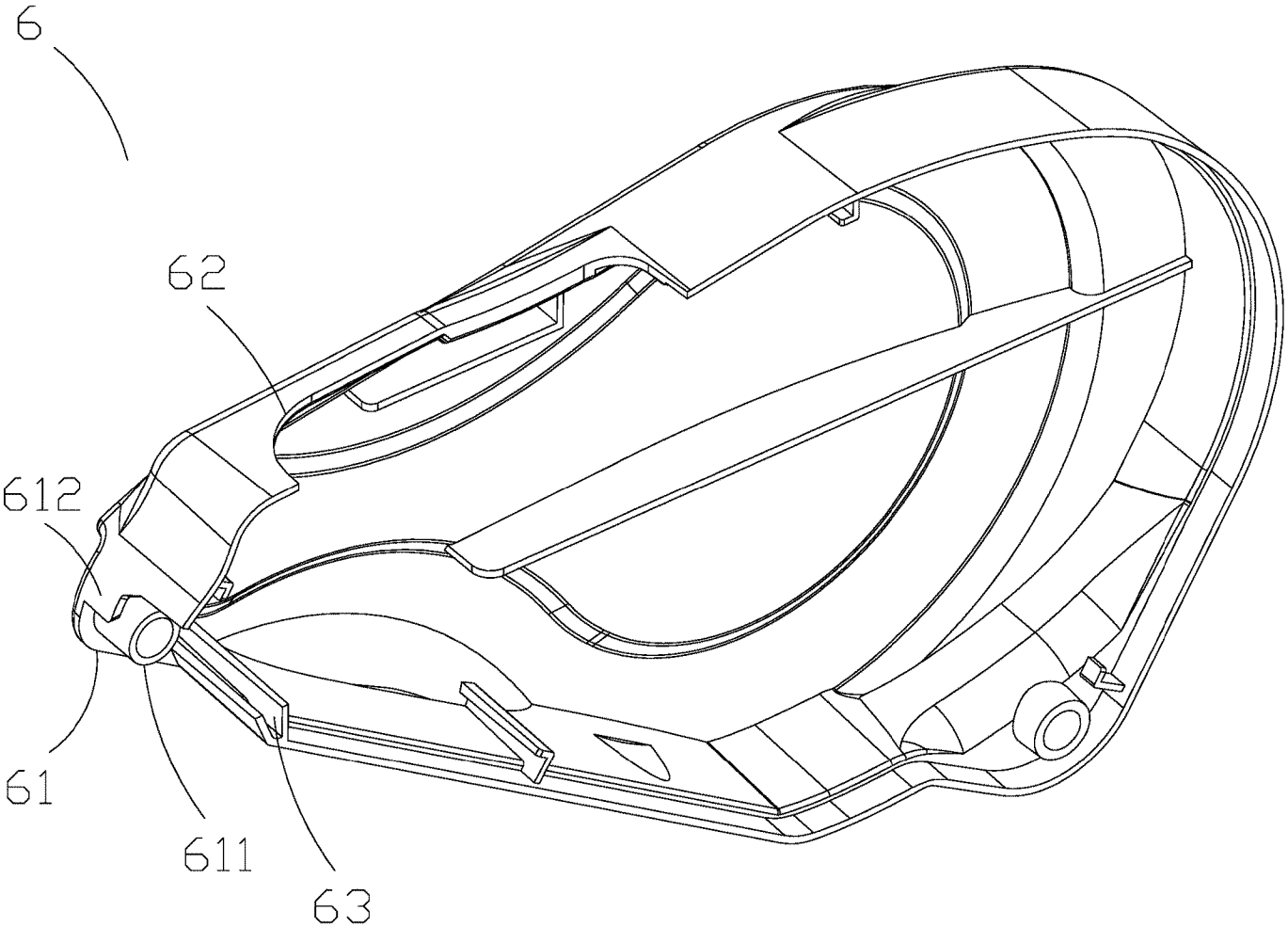
FIG. 8 is a perspective view of the second shell of FIG. 7.
Figure 9:
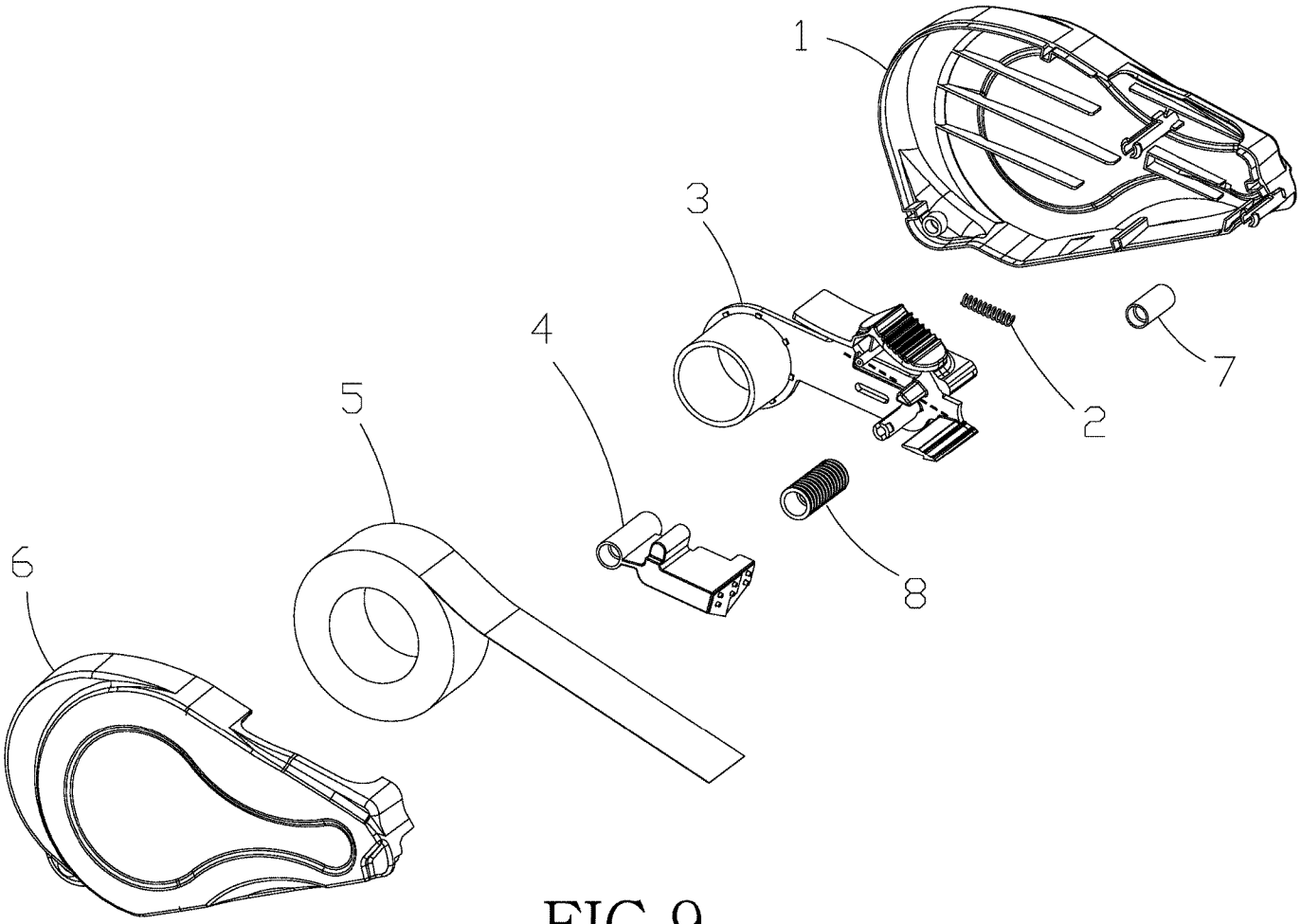
FIG. 9 is an exploded view of the handheld tape dispenser.
Figure 10:
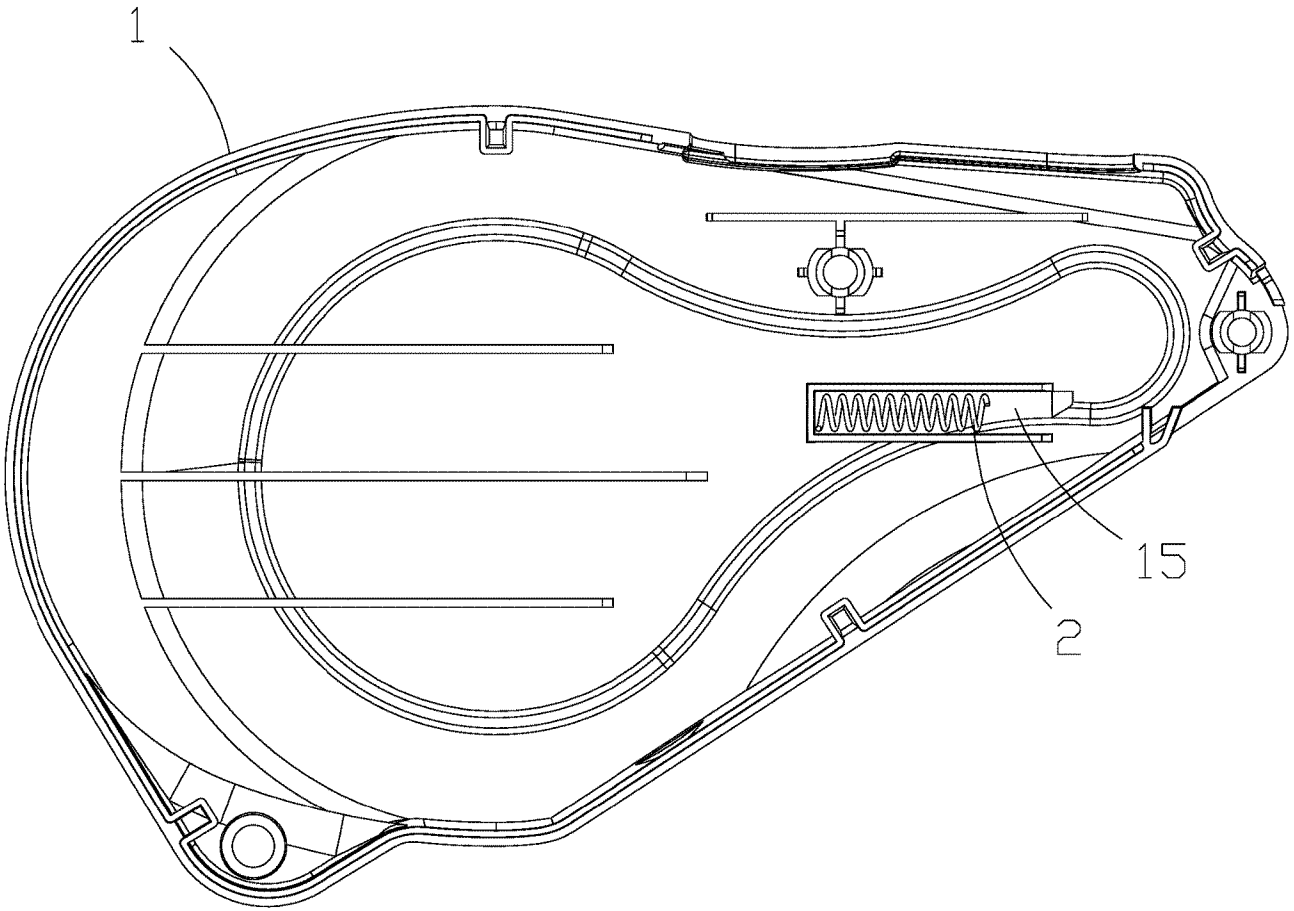
FIG. 10 is a view similar to FIG. 1 showing a torsion spring mounted in a first receptacle.
Figure 11:
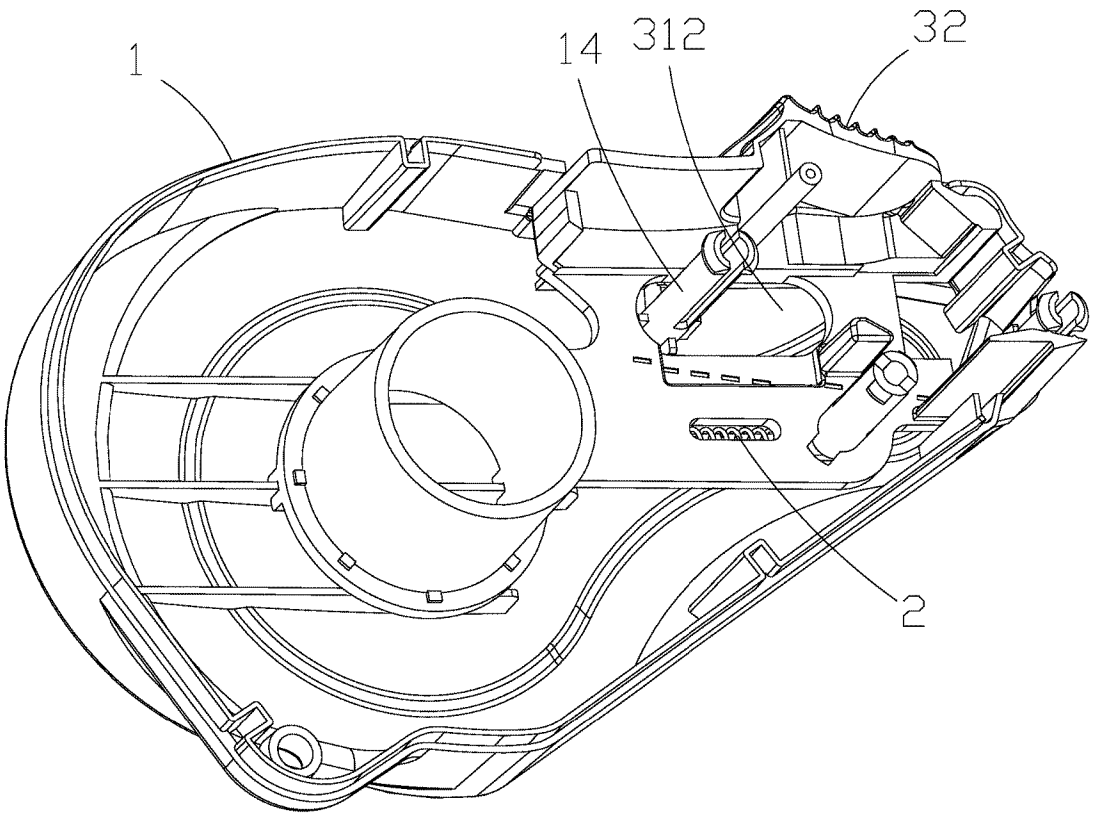
FIG. 11 is another perspective view of the first shell showing a tape core mounted therein.
Figure 12:
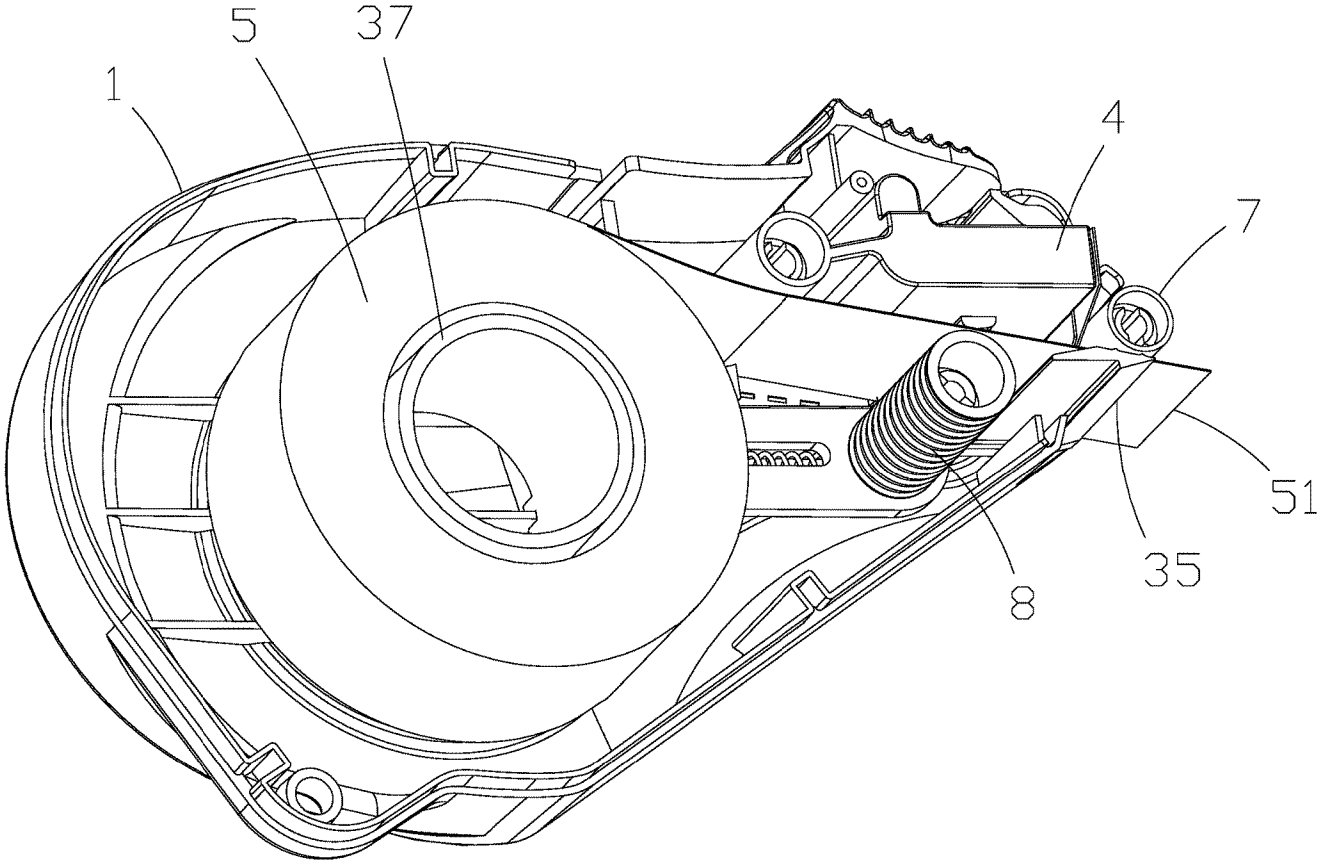
FIG. 12 is a view similar to FIG. 11 showing a mounted tape roll, a mounted roller member, and the mounted knife in a ready to apply position.
Figure 13:
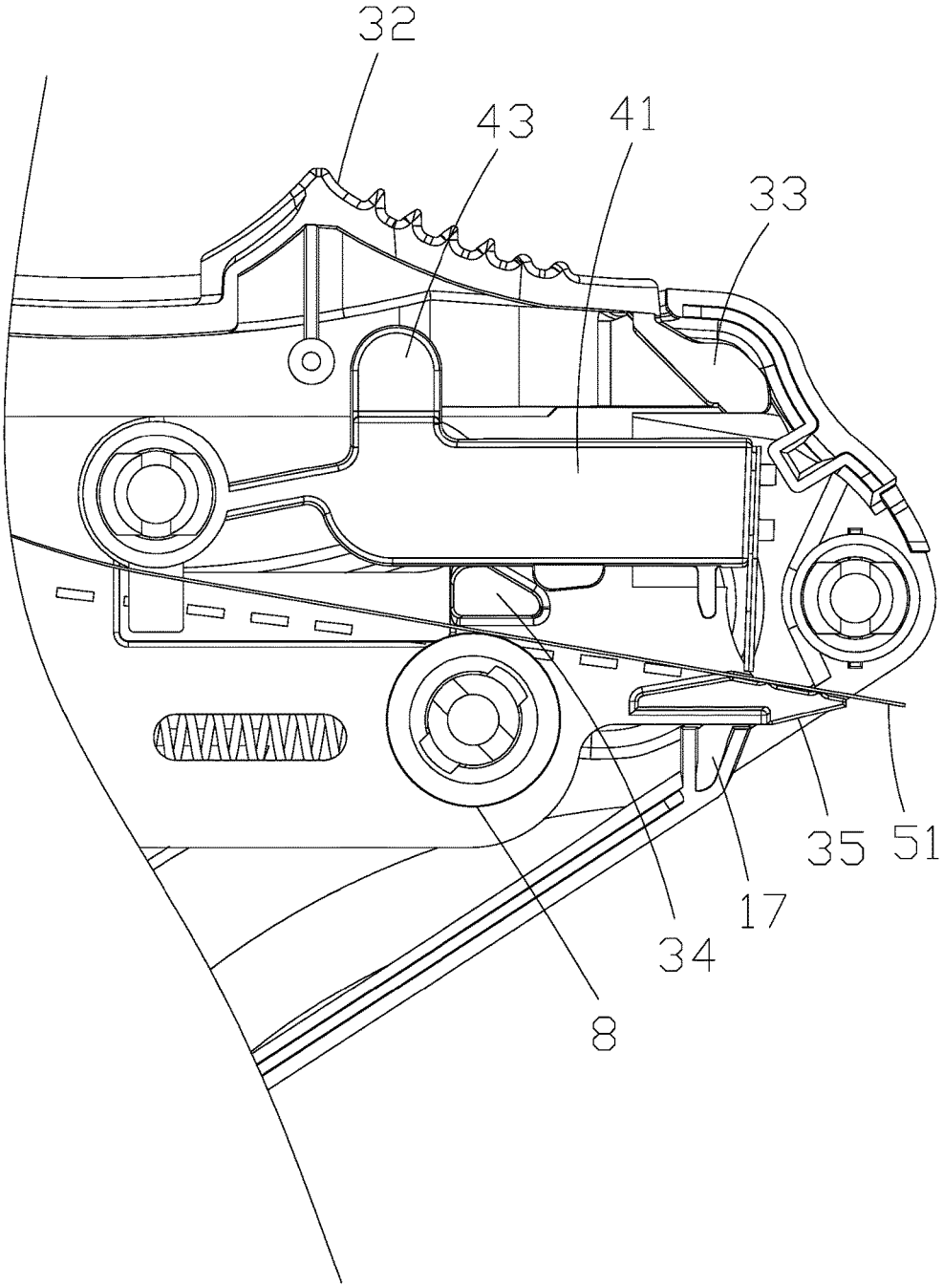
FIG. 13 is a side elevation of a forward portion of FIG. 12.
Figure 14:
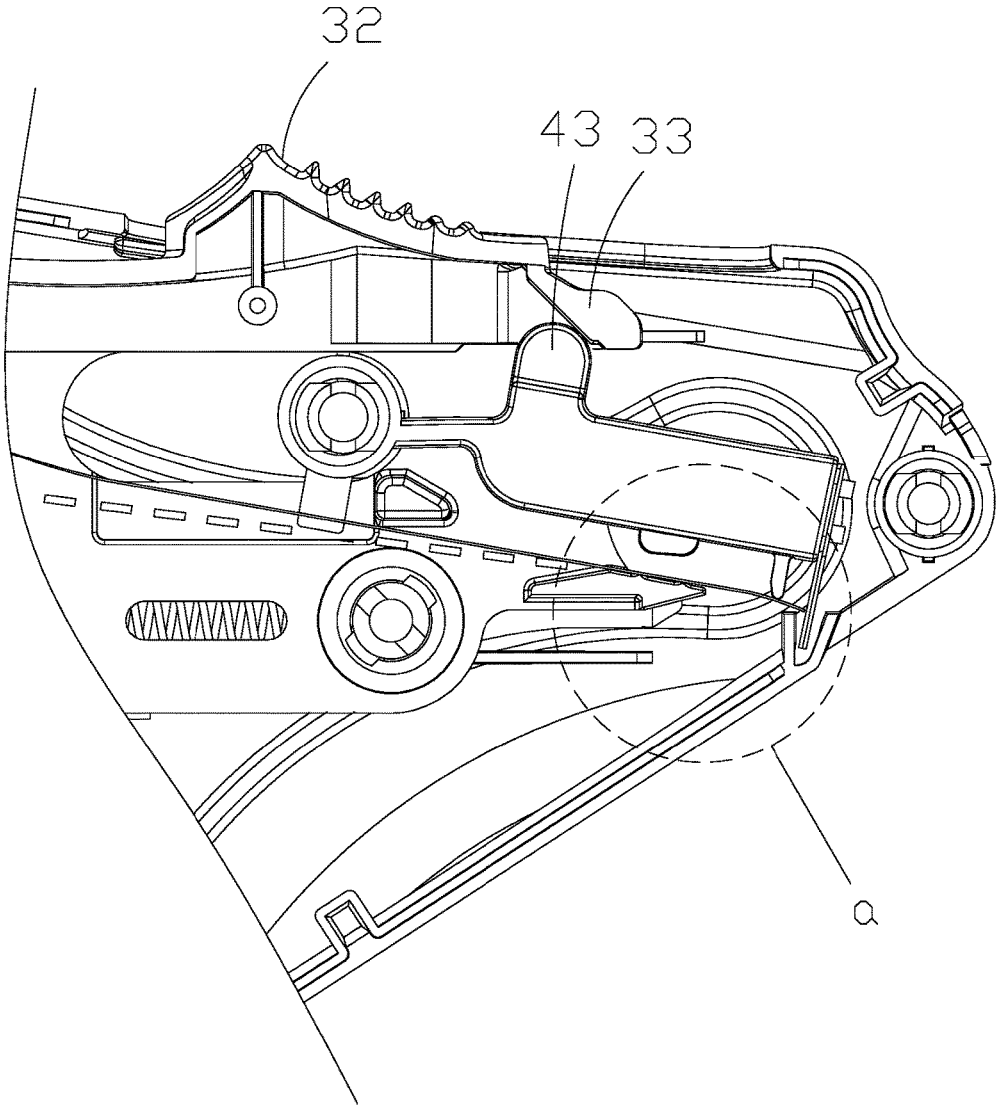
FIG. 14 is another view of FIG. 13.
Figure 15:
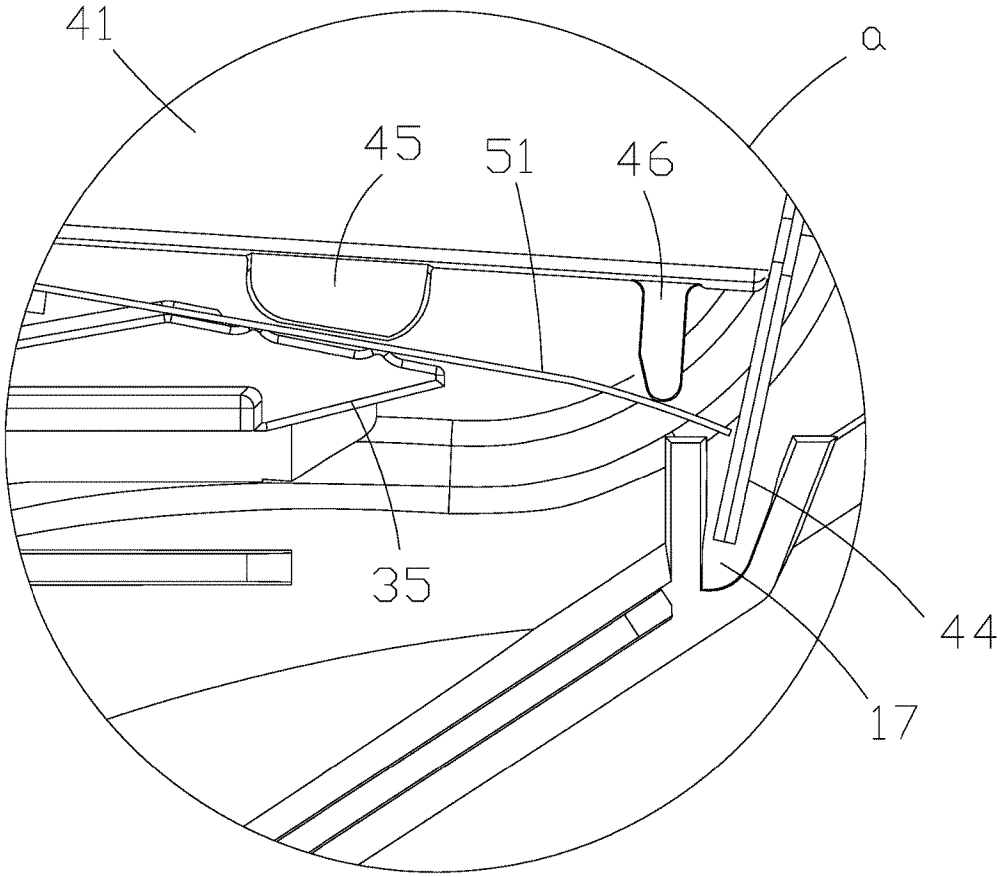
FIG. 15 is a detailed view of the circle a in FIG. 14.
Figure 16:
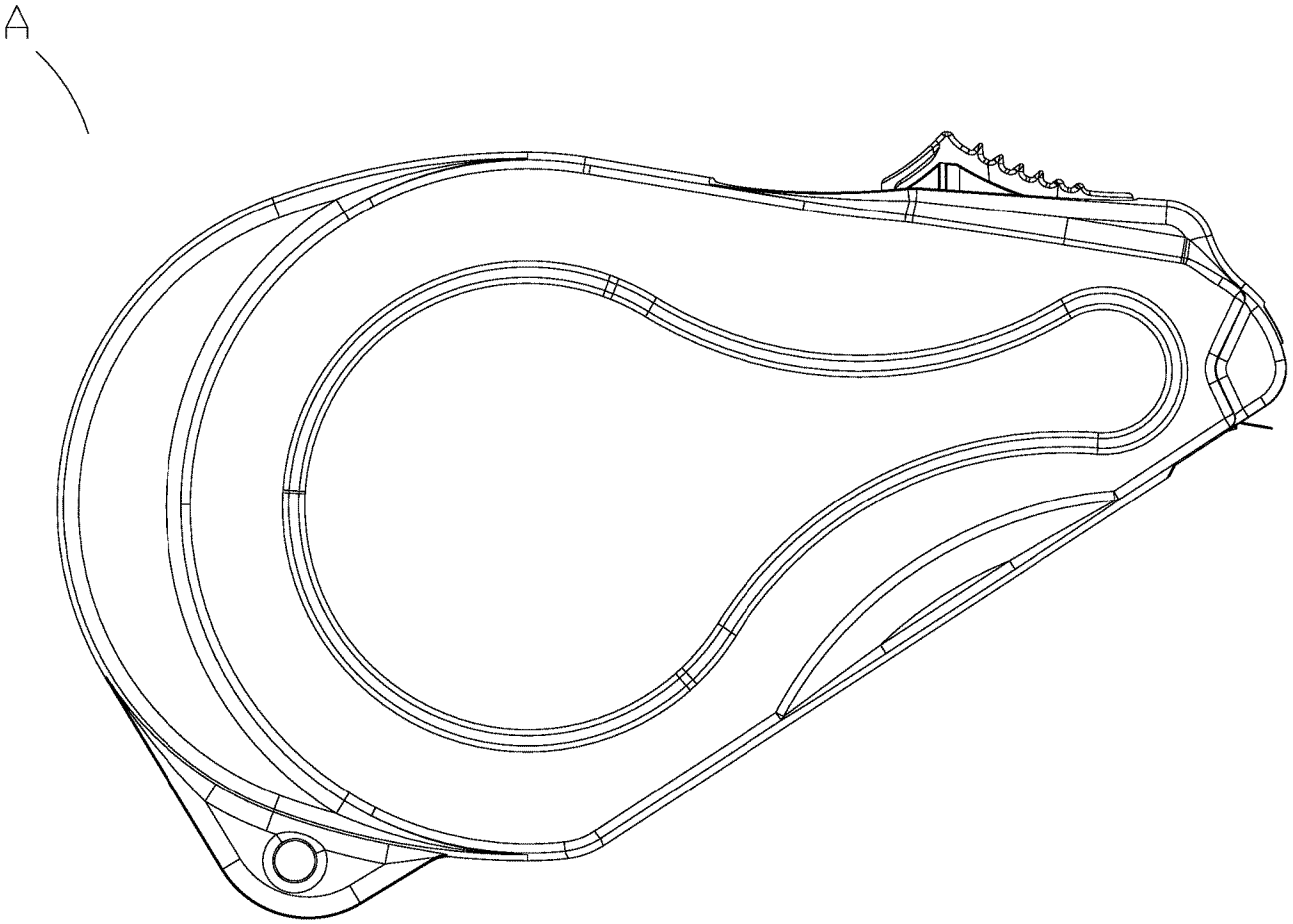
FIG. 16 is a perspective view of the handheld tape dispenser.
Figure 17:
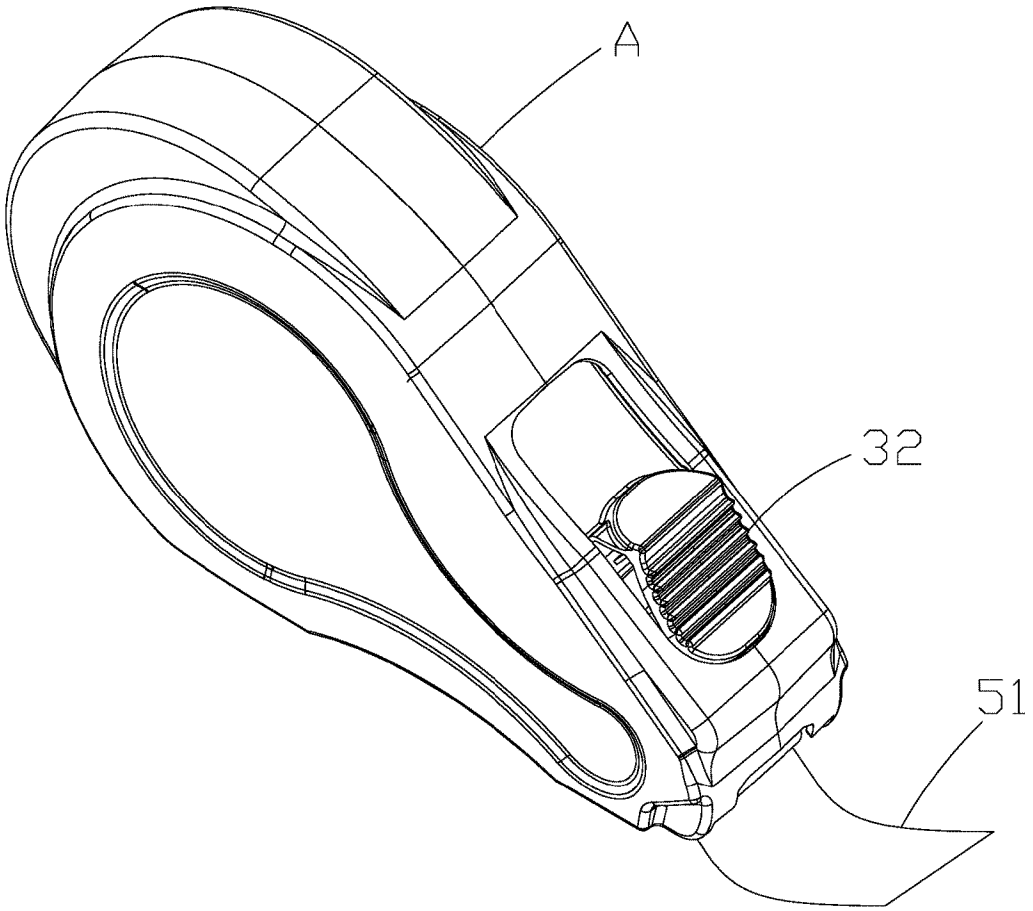
FIG. 17 is another perspective view of the handheld tape dispenser showing a portion of the tape being pulled out of the opening in a ready to apply position.
Figure 18:
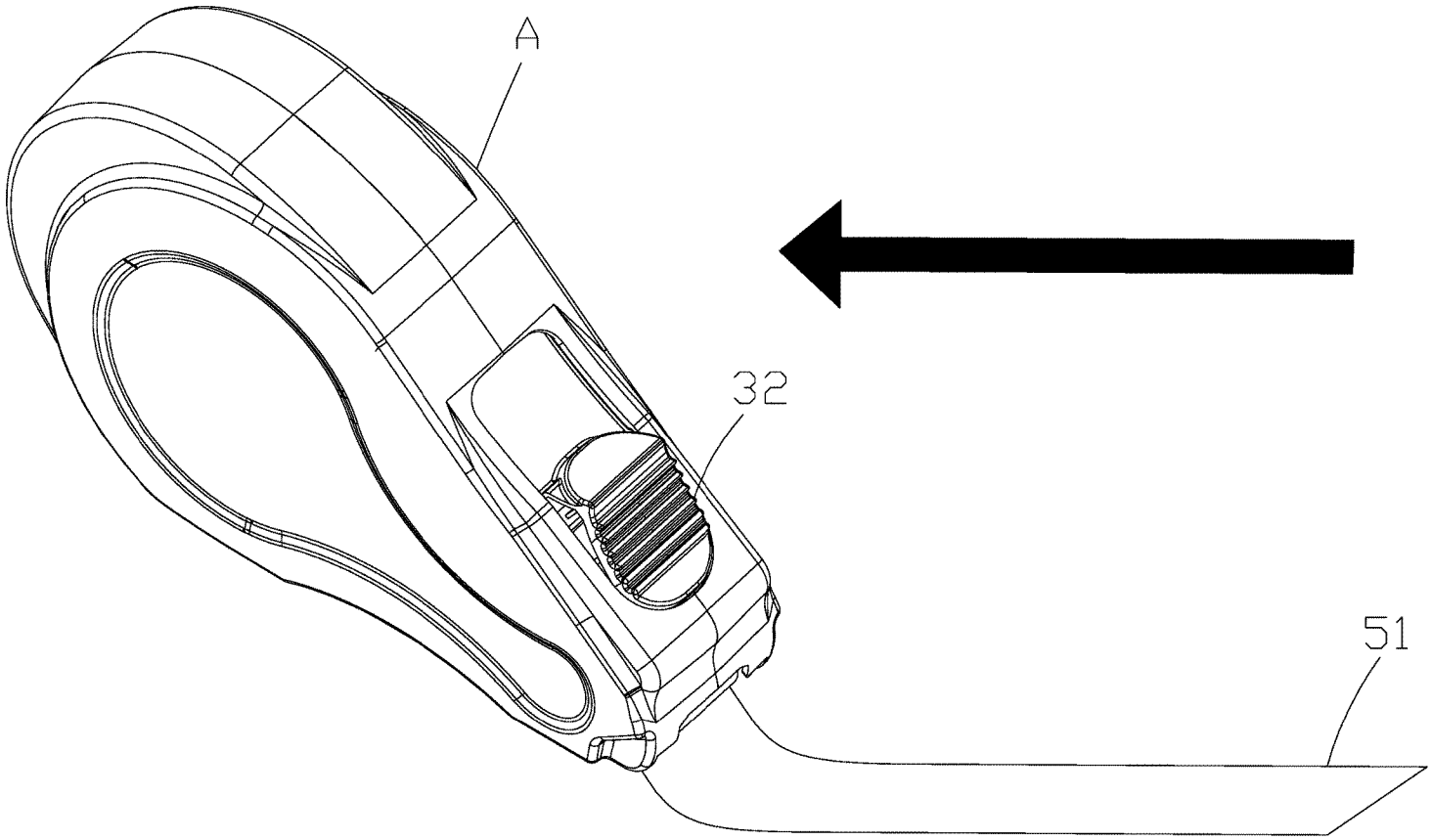
FIG. 18 is a view similar to FIG. 17 showing a sufficient portion of the tape being pulled out.
Figure 19:
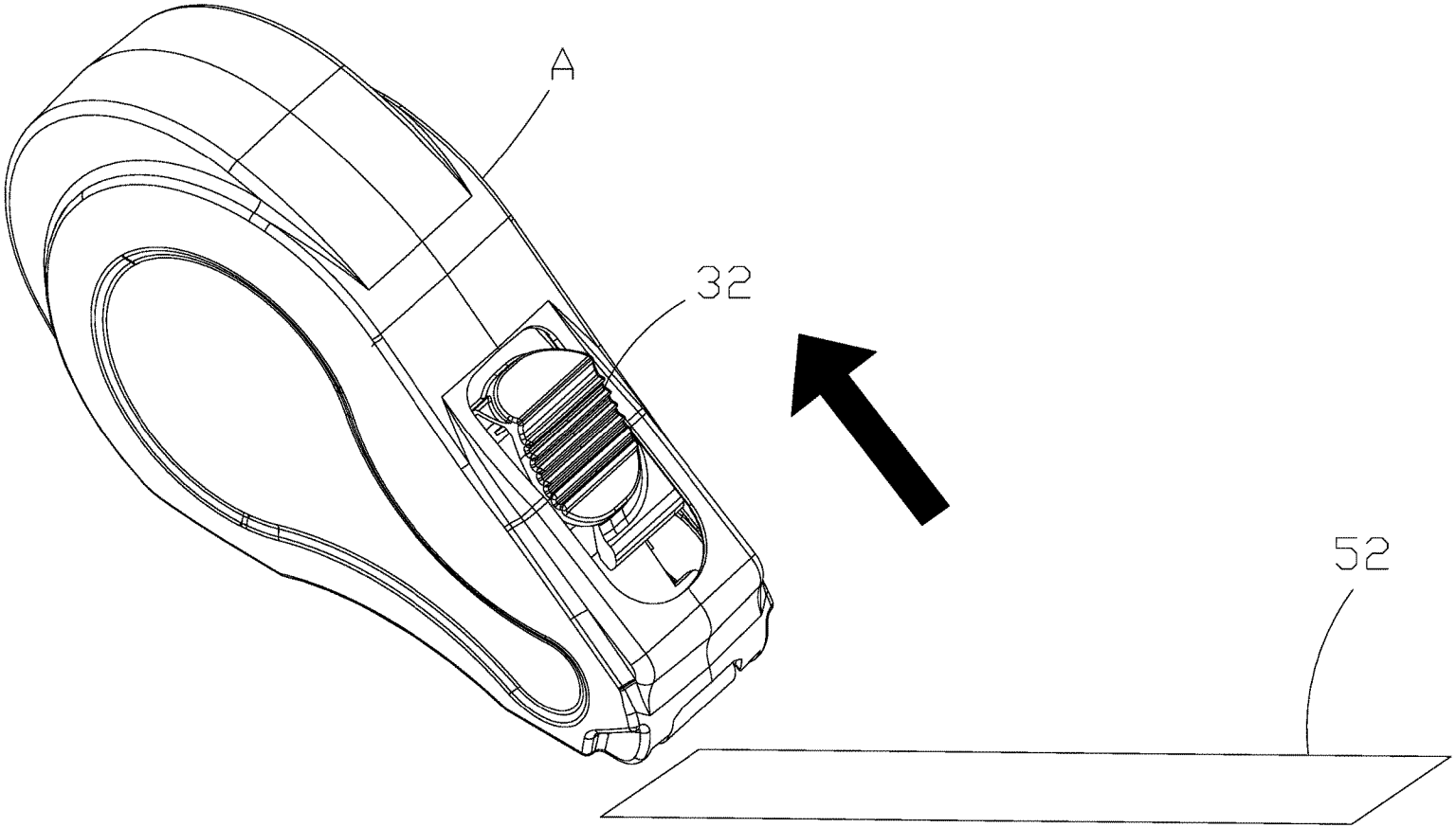
FIG. 19 is a view similar to FIG. 18 showing the sufficient portion of the tape being severed by pushing the button rearward.

Referring to FIGS. 1 to 19, a handheld tape dispenser A in accordance with the invention comprises the following components as discussed in detail below.

A first shell includes a front opening 11, a tongue member 112 adjacent to the front opening 11, a top opening 12, an internal space 13, a first hollow cylindrical member 111 in the internal space 13 and adjacent to the front opening 11, a second hollow cylindrical member 14 in the internal space 13, a first receptacle 15 in the internal space 13 with a torsion spring 2 anchored therein, a first rib 16 in the internal space 13, two second ribs 18 with the first rib 16 disposed therebetween, a second receptacle 17 adjacent to the front opening 11, and a groove 19 adjacent to the front opening 11.

A tape applying mechanism 3 includes a frame 31 having a first surface 311, an oval opening 312 with the second hollow cylindrical member 14 projecting through, a cavity 3121 adjacent to the oval opening 312, a pin 313, and a second surface 314 opposing the first surface 311; a button 32 disposed on a top; a pressing member 33 under the button 32; a first projection 34 adjacent to the cavity 3121 and under the pressing member 33; a front platform 35 under the pressing member 33 and on the second receptacle 17, the front platform 35 having a plurality of ridges 3511 on a top surface; a second projection 36 on the second surface 314 with one end of the torsion spring 2 attached thereto (i.e., the tape applying mechanism 3 being a spring-actuated mechanism); a tape core 37 on a rear end of the first surface 311 and having a bottom supported by the second ribs 18; two aligned grooves 38 on the bottom of the tape core 37, the grooves 38 being slidably placed on the first rib 16; and two wings 39 on two sides of the button 32 respectively.

A knife 4 includes a body 41 having a bottom supported by the first projection 34, two blades 44 on a front end of the body 41, a hollow cylinder 42 on a rear end of the body 41 and pivotably put on the second hollow cylindrical member 14, a peg 421 projecting downward from a bottom of the hollow cylinder 42 into the cavity 3121, an elongated, curved protuberance 43 under the button 32, a first protrusion 45 on an underside of the body 41, and a second protrusion 46 on the underside of the body 41 and being forward of the first protrusion 45.

A roll of tape 5 is wound convolutedly on the tape core 37 and has an adhesive tape 51 extending from the roll of tape 5. A second shell 6 includes a front opening 61, a top opening 62, a second receptacle 63 adjacent to the front opening 61, a third hollow cylindrical member 611 adjacent to the front opening 61, a tongue member 612 adjacent to the front opening 61, a longitudinal ridge 64, and a groove 65 adjacent to the front opening 61. The cove 6 and the first shell 1 can be complimentarily fastened together with the front opening 11 and the front opening 61 joined together, the second receptacle 17 and the second receptacle 63 joined together, the top opening 62 and the top opening 12 joined together, the third hollow cylindrical member 611 and the first hollow cylindrical member 111 joined together, and the tongue member 612 and the tongue member 112 joined together.

A roller member 8 having an uneven outer surface is put on the pin 313. A tape press roller 7 is put on both the third hollow cylindrical member 611 and the first hollow cylindrical member 111. The button 32 is disposed in the top opening 62 and the top opening 12. The adhesive tape 51 frictionally passes the outer surface of the roller member 8 and a gap between the platform 35 and the tape press roller 7 to extend out of both the front opening 11 and the front opening 61. The wings 39 are slidably disposed in the grooves 19 and 65. The longitudinal ridge 64 presses the roll of tape 5. The peg 432 is slidably disposed in the cavity 3121.

In a tape applying operation, a person may push the button 32 rearward to rearward move both the front platform 35 and the pressing member 33. Thus, the second receptacles 17, 62 are not covered by the front platform 35. The pressing member 33 urges against the protuberance 43. Thus, the knife 4 pivots clockwise relative to the hollow cylinder 42. And in turn, the first protrusion 45 presses the adhesive tape 51 against the ridges 351, the second protrusion 46 engages the adhesive tape 51, and the blades 44 move downward into the second receptacles 17, 63 to sever the adhesive tape 51. A part of the remaining portion of the adhesive tape 51 adjacent to a front end of the remaining portion of the adhesive tape 51 is adhesively secured to the ridges 351. Also, the front end of the remaining portion of the adhesive tape 51 is prevented from being curved upward due to the provision of the tongue members 112, 612.

While the invention has been described in terms of preferred embodiments, those skilled in the art will recognize that the invention can be practiced with modifications within the spirit and scope of the appended claims.

What is claimed is:

1. A handheld tape dispenser comprising:

a first shell including a front opening, a tongue member, a top opening, a first hollow cylindrical member, a second hollow cylindrical member, a first rib, two second ribs with the first rib disposed therebetween, a receptacle, and a groove;

a second shell releasably secured to the first shell and including a front opening, a tongue member, a top opening, a receptacle, a first hollow cylindrical member joined the first hollow cylindrical member of the first shell, a longitudinal ridge, and a groove;

a spring-actuated tape applying mechanism including a frame, an oval opening with the second hollow cylindrical member projecting through, a cavity adjacent to the oval opening, and a pin; a button disposed on both the top opening of the first shell and the top opening of the second shell; a pressing member under the button; a projection under the pressing member; a front platform on both the receptacle of the first shell and the receptacle of the second shell, the front platform having a plurality of ridges on a top surface; a tape core supported by the second ribs and having two aligned groove members on a bottom, the groove member being slidably placed on the first rib; and two wings on two sides of the button respectively, the wings slidably disposed in the groove of the first shell and the groove of the second shell respectively;

a knife supported by the projection and including two front blades, a rear hollow cylinder pivotably put on the second hollow cylindrical member, a peg projecting downward from a bottom of the rear hollow cylinder into the cavity, a protuberance under the button, a first protrusion on an underside of the knife, and a second protrusion on the underside of the knife and being forward of the first protrusion;

a roll of tape wound convolutedly on the tape core and including an adhesive tape extending therefrom;

a roller member put on the pin; and a tape press roller put on both the first hollow cylindrical member of the second shell and the first hollow cylindrical member of the first shell;

wherein the adhesive tape frictionally passes an outer surface of the roller member and a gap between the front platform and the tape press roller to extend out of both the front opening of the first shell and the front opening of the second shell;

wherein the longitudinal ridge presses the roll of tape;

wherein the peg is slidably disposed in the cavity;

wherein a rearward movement of the button moves both the front platform and the pressing member rearward to uncover both the receptacle of the first shell and the receptacle of the second shell, urge the pressing member against the protuberance, pivot the knife relative to the rear hollow cylinder, cause the first protrusion to press the adhesive tape against the ridges of the front platform, engage the second protrusion with the adhesive tape, move the blades downward into the receptacles to sever the adhesive tape, and adhesively secure a front end of the adhesive tape within both the first and second shells to the ridges of the front platform.

* * * * *